US009510398B1

(12) United States Patent
Miller et al.

(10) Patent No.: US 9,510,398 B1
(45) Date of Patent: Nov. 29, 2016

(54) INDUCTION HEATING APPARATUS

(71) Applicant: The Boeing Company, Chicago, IL (US)

(72) Inventors: Robert James Miller, Fall City, WA (US); Marc R. Matsen, Seattle, WA (US)

(73) Assignee: The Boeing Company, Chicago, IL (US)

( * ) Notice: Subject to any disclaimer, the term of this patent is extended or adjusted under 35 U.S.C. 154(b) by 494 days.

(21) Appl. No.: 13/663,150

(22) Filed: Oct. 29, 2012

(51) Int. Cl.
*H05B 6/12* (2006.01)
*H05B 6/06* (2006.01)

(52) U.S. Cl.
CPC ..... *H05B 6/1209* (2013.01); *H05B 6/062* (2013.01); *H05B 2206/022* (2013.01)

(58) Field of Classification Search
CPC ..... H05B 6/1209; H05B 6/062; H05B 2206/022
USPC ..... 219/620–622, 624, 627, 630, 633, 219/634–637
See application file for complete search history.

(56) References Cited

U.S. PATENT DOCUMENTS

| | | | | |
|---|---|---|---|---|
| 5,386,102 | A * | 1/1995 | Takikawa | H05B 6/1227 219/620 |
| 5,728,309 | A | 3/1998 | Matsen et al. | |
| 5,954,984 | A * | 9/1999 | Ablah | A47G 23/04 126/246 |
| 6,528,771 | B1 | 3/2003 | Matsen et al. | |
| 6,566,635 | B1 | 5/2003 | Matsen et al. | |
| 2011/0139769 | A1 | 6/2011 | Miller et al. | |
| 2011/0180531 | A1 * | 7/2011 | Shinha | H05B 6/108 219/630 |
| 2012/0145702 | A1 | 6/2012 | Miller et al. | |
| 2012/0145703 | A1 | 6/2012 | Matsen et al. | |

* cited by examiner

*Primary Examiner* — Dana Ross
*Assistant Examiner* — Kuangyue Chen
(74) *Attorney, Agent, or Firm* — Hanley, Flight & Zimmerman, LLC

(57) ABSTRACT

Induction heating apparatus are disclosed herein. An example induction heating apparatus disclosed herein includes a housing and a susceptor wire positioned in the housing. The susceptor wire is composed of a material having a relatively high magnetic permeability and a relatively high electrical resistivity sufficient to induce an eddy current in the susceptor wire when a magnetic field is applied to the susceptor wire via an induction source. The magnetic field generates the eddy current in the susceptor wire when a temperature of the susceptor wire is below a Curie point of the material of the susceptor wire. The susceptor wire limits heating to a temperature that is equal to or less than a Curie temperature associated with the material of the susceptor wire.

25 Claims, 7 Drawing Sheets

INDUCTION HEATING APPARATUS

BACKGROUND

Induction heating systems employ a magnetic field to generate heat. In particular, induction heating systems typically employ an induction source or inductor to generate a varying magnetic field in a container or vessel composed of a ferrous material. The magnetic field generates heat in the container or vessel via eddy currents and the container provides heat to contents positioned in the container via thermal conduction.

Containers, pots, pans, vessels and/or other heating or cooking apparatus are typically composed of ferrous materials (e.g., iron, steel, etc.) having a relatively high electrical conductivity. However, such ferrous materials have a relatively high Curie point, which can cause the container and/or vessel to heat to a relatively high temperature (e.g., greater than 1400° F.). Thus, known induction heating systems typically require operator control, monitoring, complex control systems or circuits, and/or continuous mixing to prevent or reduce instances of overheating, under heating, and/or uneven heating.

Further, containers or vessels composed of non-ferrous materials are not typically used with induction heating apparatus because non-ferromagnetic materials do not magnetically couple well to the magnetic field generated by the induction coil. As a result, metallic, non-ferromagnetic materials such as, for example, copper and aluminum are not typically employed with induction heating applications (e.g., induction cooking) For example, pans composed of aluminum or copper are not effectively used with an induction stove.

SUMMARY

An example heating apparatus disclosed herein includes a housing composed of a non-ferrous electrically resistive material and a susceptor wire positioned in the housing. The susceptor wire is composed of a material having a relatively high magnetic permeability and a relatively high electrical resistivity sufficient to induce an eddy current in the susceptor wire when a magnetic field is applied to the susceptor wire via an induction source. The magnetic field generates the eddy current in the susceptor wire when a temperature of the susceptor wire is below a Curie temperature of the material of the susceptor wire. The susceptor wire limits heating to a temperature that is equal to or less than the Curie temperature.

Another example heating apparatus disclosed herein includes a container having a first susceptor wire embedded in a first surface or wall of the container and a second susceptor wire embedded in a second surface or wall of the container, where the first wall is non-parallel relative to the second wall.

Another example heating apparatus disclosed herein includes means for generating a magnetic field and means for heating via induction when the means for heating is positioned proximate to the means for generating the magnetic field. The means for heating has means for inducing an eddy current that generates heat when a temperature of the means for heating is below a Curie temperature associated with a material or an alloy of the means for heating. The means for heating limits heating to a temperature that is equal to or less than the Curie temperature.

DETAILED DESCRIPTION

Example heating apparatus disclosed herein employ susceptors composed of ferromagnetic or magnetic materials to generate heat via induction. More specifically, the susceptors may be embedded or formed within a housing or container to generate heat in a container such as, for example, a pot or pan composed of glass or Pyrex®, a thin layer austenitic stainless steel container and/or any other container that cannot otherwise be effectively heated via induction heating at the typical induction stove frequencies of ~24 KHz. In particular, the example heating apparatus disclosed herein provide heat up to a temperature defined by a Curie point or Curie temperature of the example magnetic material(s) or alloy from which the susceptor is formed. As a result, the temperature-dependent magnetic properties of the example heating apparatus disclosed herein prevent overheating or under heating of surfaces, contents and/or other areas to which the heating apparatus disclosed herein may be applied. For example, the example heating apparatus may be employed to heat a container and its contents to approximately a temperature associated with a Curie point of the magnetic material (e.g., a Curie temperature). For example, because the example heating apparatus disclosed herein may be composed of different magnetic material(s) or alloys, the example heating apparatus disclosed herein can provide different upper limit or maximum temperatures for use in different applications.

The example heating apparatus disclosed herein eliminate the need for continuous monitoring, complex control systems and/or mixing to prevent overheating. Additionally, the example heating apparatus disclosed herein provide substantially uniform application of heat to a container and/or its contents, thereby preventing uneven heating. More specifically, the susceptors described herein can be used to heat all surfaces of a container adjacent the susceptors to substantially the same temperature to provide substantially even distribution of heat.

The example heating apparatus disclosed herein may be used with induction cooking applications, oil refinery applications and/or any other application(s) to provide heat to a container and/or its contents via induction heating. For example, the heating apparatus disclosed herein may be employed to implement a cooking pot, a crock pot, a slow cooker, an oil refinery container or tank, etc.

Figure 1:
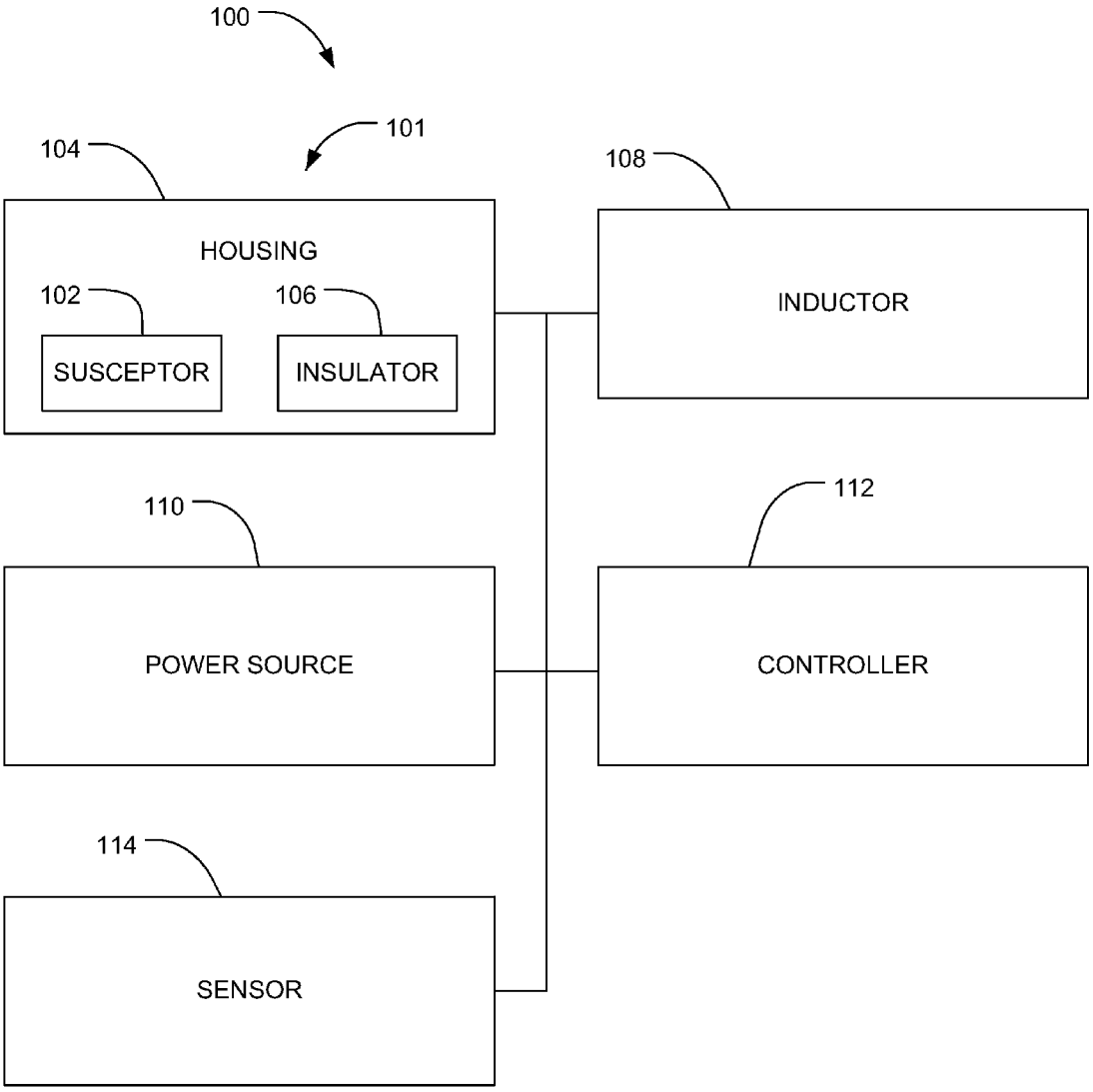
FIG. 1 is a block diagram of an example induction heating apparatus in accordance with the teachings disclosed herein.

FIG. 1 is a block diagram illustrating an induction heating apparatus 100 having an example heater 101 constructed in accordance with the teachings disclosed herein. The example heater 101 of FIG. 1 includes a susceptor element or heater 102 positioned, embedded, disposed, integrally formed and/or otherwise positioned within or adjacent at least a portion of a housing 104 (e.g., a container, a vessel, a pad, etc.). The housing 104 may be composed of a material having a relatively high electrical resistivity and a magnetic permeability of about one. For example, the housing 104 of the example heating apparatus 100 of FIG. 1 may be composed of non-ferrous materials or metals such as, for example high austenitic stainless steel, glass, Pyrex®, ceramic and/or any other non-ferrous material(s) having relatively high electrical resistivity and a magnetic permeability of about one. A relatively thin material having a relatively high electrical resistivity as described herein does not generate significant heat via induction when an alternating magnetic field of the frequencies typically used is applied to the material. Also, a material having a relatively high thermal conductivity as described herein is capable of transferring heat via conduction is placed between the susceptor and the fluid to act as a heat spreader. Further, a material having a magnetic permeability about one as described herein does not readily convey an alternating magnetic field and substantially reduces inducement of eddy currents.

The susceptor 102 of the illustrated example is composed of a ferromagnetic or magnetic material(s) or an alloy that can generate heat via induction in response to a varying magnetic field. More specifically, the susceptor 102 of the illustrated example is capable of generating heat up to a temperature defined by a Curie point of a ferromagnetic magnetic material(s) or alloy from which the susceptor 102 is formed. In particular, the ferromagnetic or magnetic material(s) or alloy has a relatively high magnetic permeability and a relatively high electrical resistivity. In some examples, the susceptor 102 may be composed of an alloy containing two or more ferromagnetic or magnetic materials. A material having a relatively high magnetic permeability and a relatively high electrical resistivity as described herein is capable of generating heat via eddy current heating when a magnetic field is applied or provided to the material (e.g., passes through the material). Examples of magnetic elements(s) include, but are not limited to, nickel, iron, cobalt, with alloying additions of molybdenum, chromium and/or other material(s), alloys and/or combinations thereof capable of readily inducing eddy currents. In addition, the susceptor 102 may be electrically insulated from the housing 104 via an electrical insulator 106 to restrict the eddy currents to the susceptor 102.

To generate a variable magnetic field, an induction source or inductor 108 such as a wire coil (e.g., a copper coil) is provided adjacent and/or in contact with the susceptor 102. The inductor 108 may be formed of any suitable material having low electrical resistance to reduce unwanted and/or uncontrollable resistive heating of the inductor 108. The inductor 108 receives electrical current and generates a variable magnetic field about the susceptor 102. For example, a power source 110 provides a voltage or electrical current to the inductor 108. The power source 110 may be configured as a portable or fixed power supply, which may be connected to a conventional 60 Hz, 110 volt or 220 volt outlet. For example, the power source 110 may provide alternating current electric power having a frequency between approximately 20 KHz and 100 KHz. In some examples, a higher frequency current provided to the inductor 108 increases the intensity of the eddy currents generated by the susceptor 102.

The heating apparatus 100 of FIG. 1 may also include a controller 112 coupled to the power supply 110 to adjust the electrical current (e.g., a frequency and/or an amplitude of an alternating current) to reduce or control a temperature of the susceptor 102 to be below the Curie temperature and/or alter a heating rate of the susceptor 102. For example, the controller 112 can control the power source 110 by varying the current, the voltage and/or the power provided to the inductor 108. For example, the controller 112 may detect the sudden change in voltage, current or power using a sensor 114 and may be configured to control a temperature output of the susceptor 102 without the need for thermocouples or other temperature sensing devices.

In operation, electrical power or current supplied to the inductor 108 via the power source 110 causes an alternating current to flow through the inductor 108 that generates a time-varying electromagnetic flux field. The magnetic flux couples primarily with the susceptor 102 due to the relatively high magnetic permeability of the susceptor 102 and the relatively low magnetic permeability of the housing 104. As a result, the magnetic flux field causes the magnetic material from which the susceptor 102 is formed to be inductively heated. More specifically, the magnetic flux induces eddy currents in the susceptor 102 which, in turn, generates heat in the susceptor 102 via inductive heating. The heat generated by the eddy currents increases the temperature of the susceptor 102, which results in a temperature increase of the housing 104 (and its contents) in contact or adjacent the susceptor 102. The inductively heated susceptor 102 thermally conducts heat to the housing 104 and its contents.

In some examples, the average temperature of the susceptor 102 or the housing 104 may increase at a relatively linear rate until the susceptor 102 reaches a temperature associated with the Curie point of the susceptor material(s). At a temperature associated with the Curie point of the susceptor 102, the susceptor 102 experiences a significant reduction in magnetic permeability at which point the concentration of magnetic fields in the susceptor 102 begins to decline (e.g., significantly decline).

As a result, the induced currents and resistive heating of the susceptor 102 declines to a level sufficient to maintain a temperature of the susceptor 102 at the Curie temperature. Therefore, the susceptor 102 significantly facilitates control of the heating apparatus 100 and prevents overheating and/or under heating. In particular, the heating apparatus 100 may be heated without monitoring or control because the susceptor 102 maintains the Curie temperature when the susceptor 102 becomes non-magnetic, thereby preventing overheating. In contrast, without the above-described Curie temperature effect, achieving temperature uniformity requires precise control of the input power to a conductor or coil, conductor or coil configuration, and an input electrical current frequency. Even with such precise control, local hot spots can develop because of spatial variations in the magnetic field strength.

Thus, the example heating apparatus 100 disclosed herein prevents heating of the housing 104 and/or its contents to a temperature that is greater than a temperature associated with a Curie point or temperature of the susceptor 102. The susceptor 102 may be configured to provide an upper temperature limit (e.g., a maximum temperature) associated with a Curie point of the material sufficient or compatible with the heating requirements or application to which the heating apparatus 100 may be applied. For example, the magnetic material from which the susceptor 102 is made can be selected to correspond to the desired upper limit or maximum temperature to which the housing 104 or its contents is to be heated by the susceptor 102. As a result, different susceptors 102 may be employed to provide different upper temperature limits.

Figure 2:
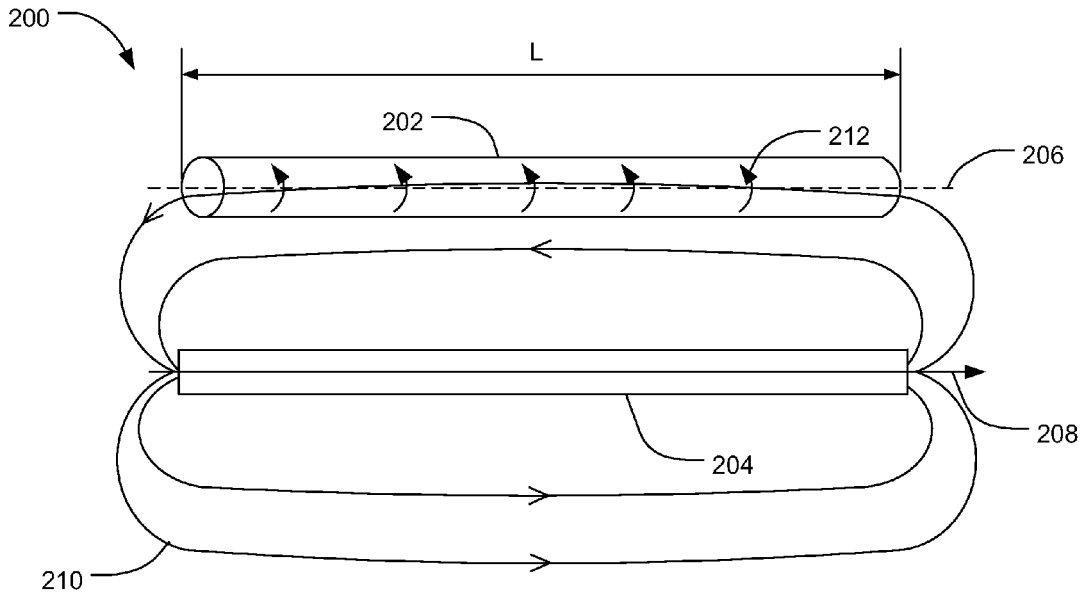
FIG. 2 is an example susceptor wire that may be used to implement the example heating apparatus of FIG. 1.

FIG. 2 illustrates an example susceptor 200 in accordance with the teachings disclosed herein. The example susceptor 200 of FIG. 2 may be used to implement the susceptor 102 of the example heating apparatus 100 of FIG. 1. In the illustrated example, the susceptor 200 (e.g., a smart susceptor) of FIG. 2 comprises a susceptor wire 202. More specifically, the susceptor wire 202 may be embedded in a housing such as the housing 104 of FIG. 1. In some examples, the susceptor wire 202 disclosed herein may have either a predetermined length and/or an arbitrary length. For example, the susceptor wire 202 of FIG. 2 is a magnetic alloy wire having an arbitrary length L.

The susceptor wire 202 may be arranged relative to an inductor or conductor 204 such that a longitudinal axis 206 of the susceptor wire 202 is substantially parallel to an electrical current 208 flowing through the inductor 204. In this manner, a varying magnetic field 210 generated by the inductor 204 induces eddy currents 212 in the susceptor wire 202. Therefore, the susceptor wire 202 of the illustrated example may be positioned generally parallel relative to the varying magnetic field 210 and/or the inductor 204 to increase eddy current heat generation efficiency. In this manner, at least a portion of the magnetic field 210 may pass through a longitudinal length of the susceptor wire 202. However, in other examples, although less efficient, at least a portion of the susceptor wire 202 may be positioned in a non-parallel relationship relative to the magnetic field 210 and/or the inductor 204. As shown in FIG. 2, the varying magnetic field 210 generated by the inductor 204 generates eddy currents 210 circumferentially around the susceptor wire 202. The eddy currents 212 circulate radially about the longitudinal axis 206 of the susceptor wire 202.

Figure 3:
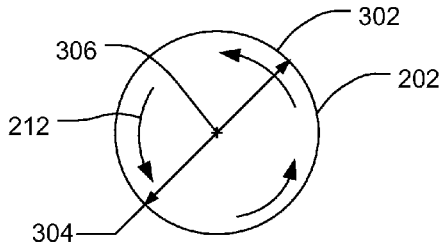
FIG. 3 is a cross-sectional view of the example susceptor wire of FIG. 2 prior to the susceptor wire attaining a Curie temperature.

FIG. 3 is a cross-sectional view of the susceptor wire 202 of FIG. 2 shown when a temperature of the susceptor wire 202 is less than the Curie temperature. The susceptor wire 202 and the inductor 204 are sized and/or configured such that at temperatures below the Curie temperature of the magnetic material(s) of the susceptor wire 202, the magnetic field 210 is concentrated near or adjacent an outer surface 302 (e.g., a skin) of the susceptor wire 202 due to the magnetic permeability of the material(s). When the susceptor wire 202 is positioned in close proximity relative to the inductor 204, the concentration of the magnetic field 210 results in relatively large eddy currents 212 in the outer surface 302 of the susceptor wire 202. The induced circumferential eddy currents 212 result in resistive heating of the susceptor wire 202.

These circumferential eddy currents 212 are provided as long as an electrical skin depth is smaller than about half of a diameter 304 of the susceptor wire 202. An electrical skin depth as described herein is a depth at which the magnetic field 210 intensity declines. For a typical induction frequency of 20 KHz, the high magnetic permeability of the susceptor wire 202 results in an electrical skin depth of approximately about 0.01 inches. Therefore, the susceptor wire 202 may be chosen to have a diameter of approximately 0.02 inches. More specifically, a relatively high frequency alternating electrical current 208 flowing through the inductor 204 causes the concentration of eddy currents 212 near the outer surface 302 of the susceptor wire 202 rather than a uniform current density distribution through the cross-section of the susceptor wire 202. Because resistance heating in the inductor 204 is proportional to amperage squared times electrical resistance, the high concentration of the eddy currents 212 near the relatively small cross sectional area adjacent the outer surface 302 of the susceptor wire 202 results in increased heating of the susceptor wire 202 compared to when the eddy currents 212 are concentrated toward a central or inner surface 306 of the susceptor wire 202.

Figure 4:
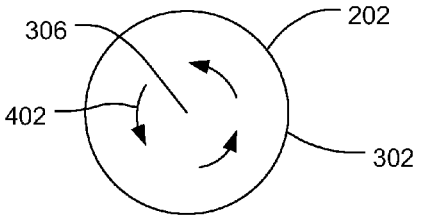
FIG. 4 is a cross-sectional view of the example susceptor wire of FIG. 2 after the susceptor wire has attained a Curie temperature.

FIG. 4 is a cross-sectional view of the susceptor wire 202 of FIGS. 2 and 3 after the susceptor wire 202 attains the Curie temperature. When the susceptor wire 202 approaches a temperature corresponding to the Curie point of the particular magnetic material or alloy from which the susceptor wire 202 is composed, the magnetic permeability of the susceptor wire 202 decreases to about one, thereby causing the electrical skin depth to increase greater than the diameter 304 of the susceptor wire 202. As a result, induction heating adjacent the outer surface 302 (e.g., the skin) of the susceptor wire 202 significantly decreases to near-zero. More specifically, upon attainment of the Curie temperature, the susceptor wire 202 loses its magnetic properties, thereby preventing generation of the eddy currents 212 near the outer surface 302 of the susceptor wire 202 and resulting in a reduction or cessation of the inductive heating of the susceptor wire 202. In other words, electrical currents 402 are more concentrated in and/or adjacent the interior surface 306 of susceptor wire 202, which do not generate significant heat to the outer surface 302 of the susceptor wire 202. Thus, when the Curie point of the susceptor wire 202 is attained, the effect of the electrical skin depth when combined with a relatively small cross section of the susceptor wire 202 causes the electric currents on opposite sides of the susceptor wire 202 to interfere and to largely cancel each other reducing or diminishing heating to almost zero.

Figure 5:
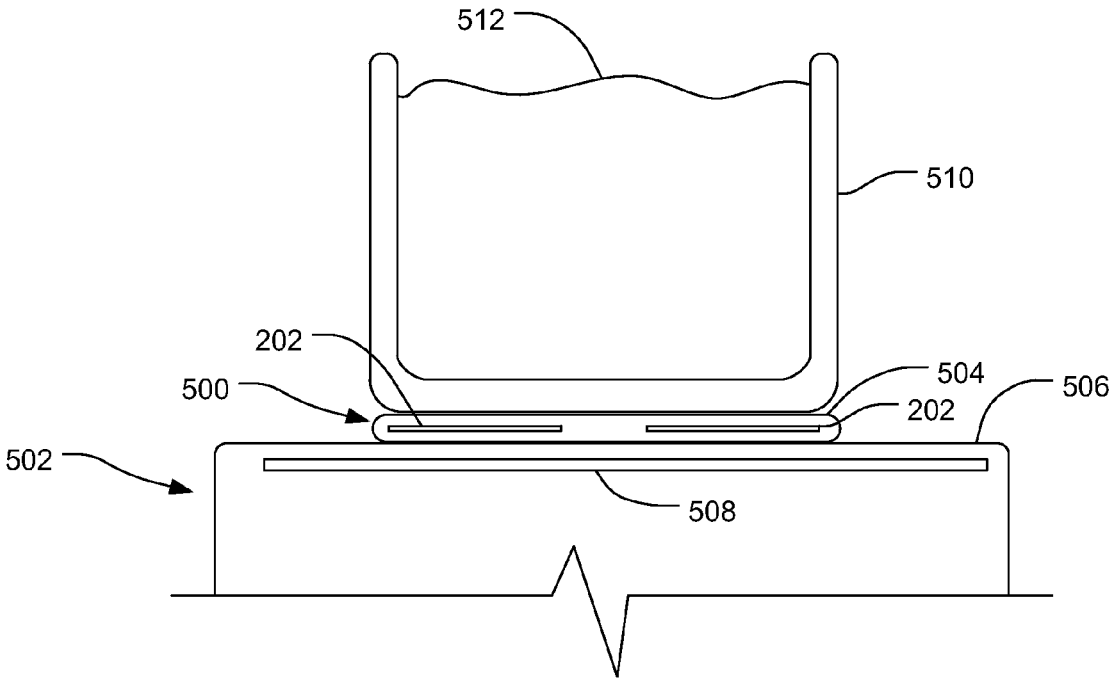
FIG. 5 illustrates an example heating apparatus in accordance with the teachings disclosed herein.

FIG. 5 illustrates an example heating apparatus 500 disclosed herein that may be used with, for example, an induction cooking apparatus or stove 502. Referring to FIG. 5, the example heating apparatus 500 includes a housing or pad 504 implemented with a plurality of the example susceptor wires 202 of FIGS. 2-4. The pad 504 may be positioned on an induction cook top 506 of the induction cooking apparatus 502 (e.g., an induction stove). More specifically, the pad 504 and/or the susceptor wires 202 are positioned in close proximity to an induction source or inductor 508 (e.g., a coil wire, a spiral wound coil, a looped wire, etc.) of the cook top 506. A container or pot 510 may be positioned on top of the pad 504.

The pad 504 of the illustrated example is composed of a non-ferrous material such as, for example, glass and/or any other highly electrically resistive material having a magnetic permeability about one. However, as noted above, the susceptor wires 202 are formed of ferromagnetic material(s) or alloys and are embedded or positioned in the pad 504. As a result, the pad 504 may provide an adaptor to enable a container such as the container 510 composed of non-ferrous materials such as copper, aluminum and/or glass to be used with induction cooking apparatus 502. Also, the pad 504 of the illustrated example has a cylindrical shape or profile. However, in other examples, the pad 504 may have a rectangular shape or profile, an arbitrary shape or profile and/or any other suitable shape or profile.

In operation, the inductor 508 may receive alternating electrical current via a power source (e.g., the power source 110 of FIG. 1). The electrical current flowing through the inductor 508 provides a magnetic field (e.g., the magnetic field 210 of FIG. 2) that generates eddy currents (e.g., the eddy currents 212 of FIG. 2) in the susceptor wires 202 positioned in the pad 504. When the susceptor wires 202 are positioned in close proximity relative to the inductor 508, the concentration of the magnetic field results in relatively large eddy currents in the outer surfaces (e.g., the outer surface 302 of FIG. 3) of the susceptor wires 202. The electrical resistance of the susceptor wires 202 causes the eddy currents to generate heat, thereby increasing the temperature of the susceptor wires 202. In turn, the heat generated by the susceptor wires 202 increases the temperature of the container 508 and/or its contents 512 via thermal conduction.

As noted above, the example susceptor wires 202 provide an upper limit or maximum temperature in accordance with the Curie temperature of the material or alloy from which the susceptor wires 202 are formed. In this manner, a temperature of the contents 512 of the container 510 will not exceed a temperature corresponding to the Curie temperature of the susceptor wire 202. Instead, when the Curie temperature is attained in the susceptor wires 202, the temperature of the contents 512 is maintained at approximately (e.g., slightly less than) the Curie temperature of the susceptor wires 202. Therefore, a complex temperature control system, monitoring and/or continuous mixing of the contents 512 is not necessary because the susceptor wires 202 significantly reduce or prevent over heating of the contents 512. As a result, a controller or control system may not be employed to prevent overheating. Thus, in some examples, an operator may set the container 510 on the pad 504 without having to set, control and/or adjust a temperature.

Additionally or alternatively, a plurality of different pads, similar to the pad 506, having susceptor wires 202 composed of different materials and/or alloys may be employed to provide pads having different Curie temperatures to provide different maximum or upper limit temperatures. For example, a susceptor composed of an alloy containing 31% wt. nickel and 63% wt. iron provides a control temperature of approximately 212° F. for use in heating a liquid (e.g., boiling water). In contrast, a susceptor composed of an alloy containing 30% wt. nickel and 70% wt. iron provides a lower Curie temperature (e.g., 150° F.) for melting, for example, chocolate, and a susceptor composed of an alloy containing 36% wt. nickel and 64% wt. iron may provide a relatively higher Curie temperature (e.g., 350° F.). Thus, different pads may be positioned on cook top 506 of the cooking apparatus 502 (e.g., simultaneously) where each of the pads provides a different maximum temperature value.

Figure 6:
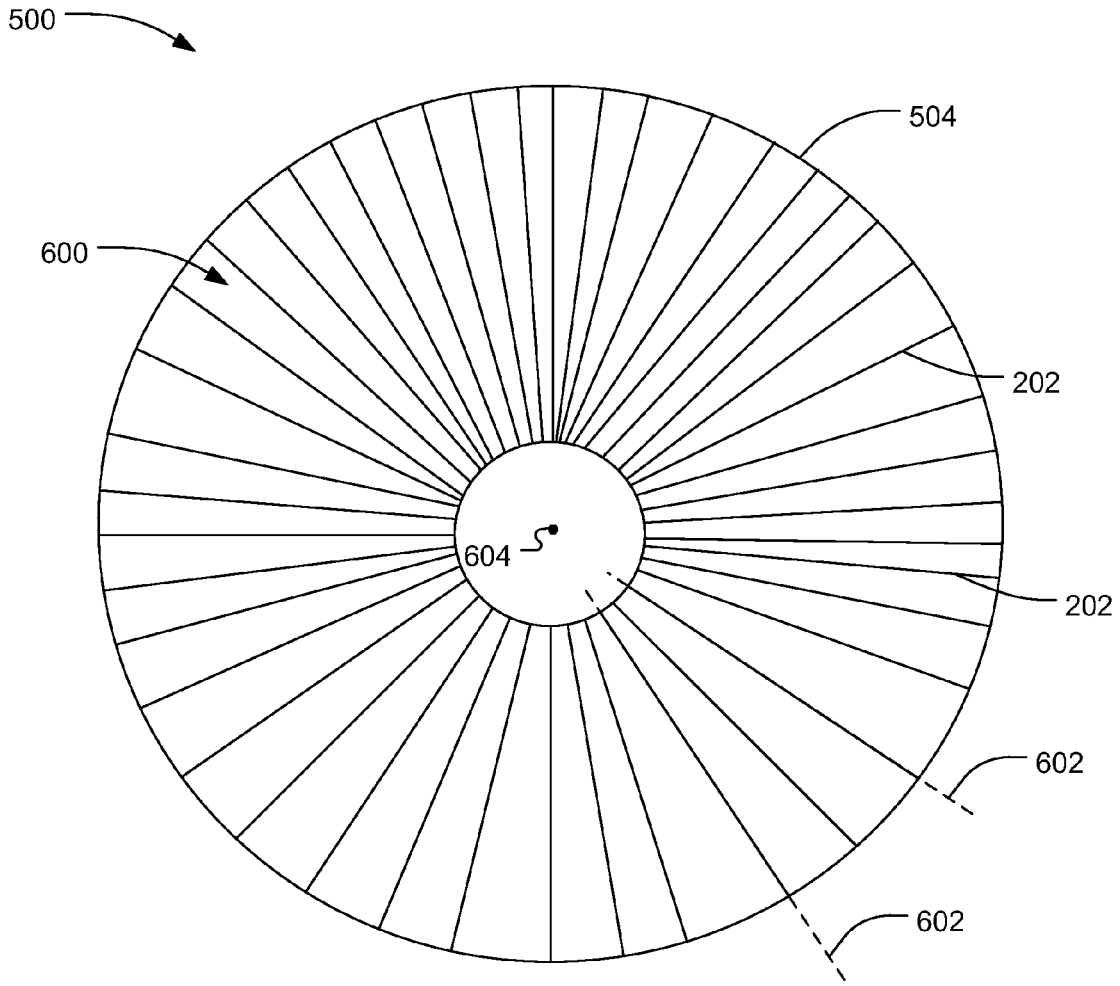
FIG. 6 is a cross-sectional plan view of the example heating apparatus of FIG. 5.
Figure 7:
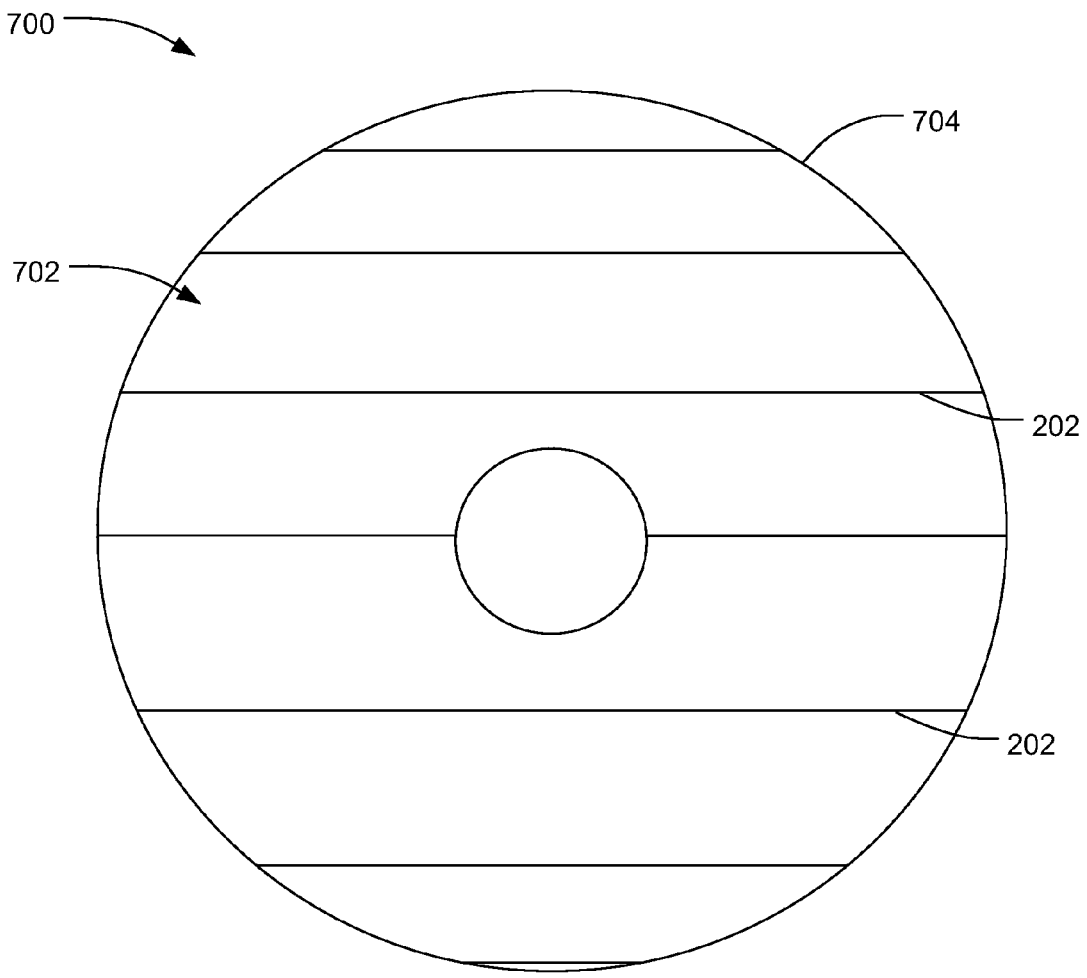
FIG. 7 is a cross-sectional plan view of another example heating apparatus similar to the heating apparatus of FIG. 5.

FIG. 6 is a cross-sectional plan view of the example heating apparatus 500 of FIG. 5. The susceptor wires 202 are embedded, positioned or otherwise integrally formed with the housing or pad 504. As shown in FIG. 6, the susceptor wires 202 are arranged in a pattern 600 so that their longitudinal axes 602 are parallel to a magnetic field generated by the inductor 508 (FIG. 5) to substantially increase or maximize the induced eddy current intensity. The inductor 508 of FIG. 5 is a spirally wound electrical conductor generating a magnetic field in a radial direction. Therefore, as shown in FIG. 6, the susceptor wires 202 are arranged in the pad 504 in a radial pattern 600 along a plane perpendicular to a longitudinal axis 604 of the pad 504. However, in other examples, the susceptor wires 202 may be arranged in any other pattern and/or may be randomly positioned in the pad 504. For example, FIG. 7 illustrates another example heating apparatus 700 disclosed herein having susceptor wires 202 arranged in a linear or straight line pattern 702 in a pad 704. Such a configuration is suitable for inductors that provide substantially parallel and/or linear magnetic fields.

Figure 8:
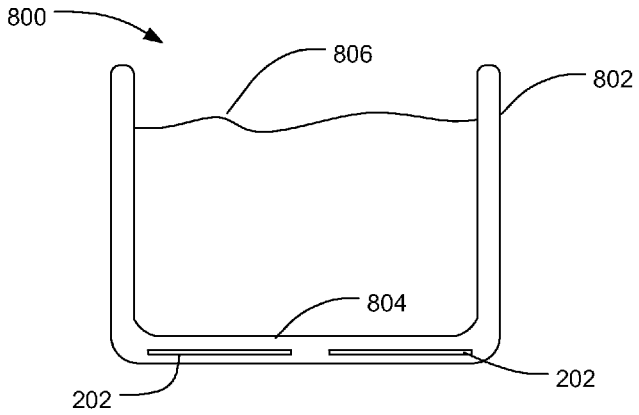
FIGS. 8-13 illustrate other example heating apparatus disclosed herein.

FIG. 8 illustrates another example heating apparatus 800 disclosed herein. In the illustrated example of FIG. 8, a container 802 includes one or more susceptor wires 202 positioned or embedded in a surface or wall 804 of the container 802. In the illustrated example, the susceptor wires 202 are arranged in a bottom surface of the container 802. The susceptor wires 202 may be arranged in a radial orientation, spiral orientation, straight orientation and/or any other orientation such that a magnetic field generated by an induction source or inductor generates eddy currents in the susceptor wires 202 (e.g., orientating a susceptor wires 202 such that at least a portion of a longitudinal axis of the susceptor wire 202 is substantially parallel relative to a magnetic field generated by an induction source or inductor positioned in proximity to the container 802). The susceptor wires 202 may be integrally formed with the container 802 via insert molding, casting and/or any other suitable manufacturing process(es).

The container 802 of the illustrated example may be a pot, a pan, a vat, a storage container, a tank, and/or any other suitable container. For example, the container 802 may be composed of a metal such as, for example, high austenitic stainless steel, or glass, ceramic and/or any other suitable material having a magnetic permeability of one or about 1 and relatively high electrical resistivity. Also, metals with low electrical resistivity and high thermal conductivity such as copper can act as thermal spreaders between the smart susceptors and the fluid in the container. In the example of FIG. 8, the container 802 may be employed with an induction cooking stove or apparatus. Thus, the example susceptors wires 202 may be embedded or positioned inside the container 802 to enable non-ferrous materials to be used with induction heating stoves or cooking apparatus.

In operation, the container 802 may be positioned in proximity to an inductor (e.g., the inductor 508 of FIG. 5). For example, the container 802 may be positioned directly on the cook top 506 of the cooking apparatus 502 of FIG. 5 without the need for the pad 504. In such an example, the magnetic field generated by the inductor 508 causes the susceptor wires 202 to heat via eddy current heating until the temperature approaches a Curie temperature of the material of the susceptor wires 202. The heat generated by the susceptor wires 202 may heat contents 806 in the container 802 via thermal conduction. To provide different temperature limits, a plurality of containers similar to the container 802 may be formed with susceptor wires 202 composed of different materials or alloys to provide different maximum temperature limits for heating different contents placed in the respective containers.

Figure 9:
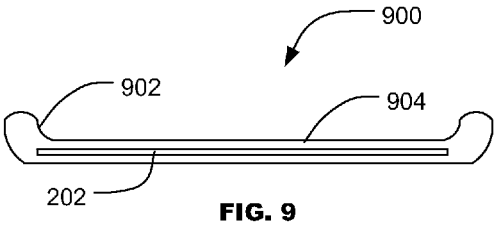

FIG. 9 illustrates another example heating apparatus 900 disclosed herein. In particular, the heating apparatus 900 is a container 902 composed of glass or Pyrex® having a susceptor wire 202 embedded in a wall or surface 904 of the container 902. As a result, the Pyrex® container 902 may be used with an induction cooking apparatus such as, for example, the induction cooking apparatus 502 of FIG. 5. In other words, the Pyrex® container 902 may be positioned directly on the cook top 506 of the induction cooking apparatus 502.

Figure 10:
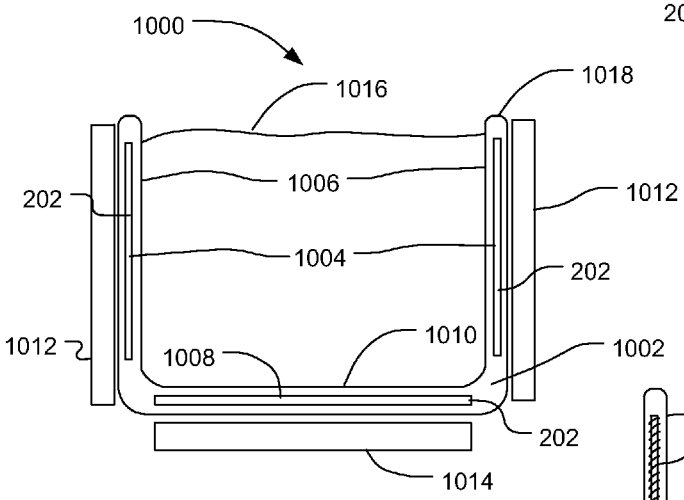

FIG. 10 illustrates yet another example heating apparatus 1000 disclosed herein. In the illustrated example of FIG. 10, the heating apparatus 1000 includes a container 1002 having a plurality of susceptor wires 202 embedded in multiple surfaces and/or walls of the container 1002. The example container 1002 may be a tank or container for use in industrial applications such as, for example, oil refinery applications.

As shown in FIG. 10, a first plurality of susceptor wires 1004 is positioned or embedded in a side wall 1006 of the container 1002 (e.g., a vertical side wall) and a second plurality of susceptor wires 1008 is positioned or embedded in a bottom surface 1010 of the container 1002. More generally, the side wall 1006 is substantially non-parallel (e.g., substantially perpendicular) relative to the bottom surface 1010. Additionally or alternatively, the first plurality of susceptor wires 1004 may be positioned or oriented such that a longitudinal axis of the first plurality of susceptor wires 1004 is positioned substantially parallel relative to a varying magnetic field generated by a first induction source 1012 positioned adjacent the side wall 1006 (e.g., outside of the wall 1006) and the first plurality of susceptor wires 1004. In this manner, at least a portion of the magnetic field may pass through a longitudinal length of the susceptor wires 1004. Additionally or alternatively, the second plurality of susceptor wires 1008 may be positioned or oriented such that a longitudinal axis of the second plurality of susceptor wires 1008 is positioned substantially parallel relative to a varying magnetic field generated by a second induction source 1014 positioned adjacent the bottom surface 1010 and the second plurality of susceptor wires 1008. In this manner, at least a portion of the magnetic field may pass through a longitudinal length of the susceptor wires 1008. In the illustrated example, the first induction source 1012 may provide a magnetic field that is oriented either substantially similar to or different from an orientation of a magnetic field generated by the second induction source 1014. In other words, the first plurality of susceptor wires 1004 may be positioned in a straight or linear orientation or pattern (e.g., a vertical orientation) and the second plurality of susceptor wires 1008 may be positioned in a radial orientation or pattern.

Further, each of the susceptor wires 202 from the first plurality of susceptor wires 1004 may be composed of a first material or alloy and each of the susceptor wires 202 from the second plurality of susceptor wires 1008 may be composed of a second material or alloy. For example, the first plurality of susceptor wires 1004 may be composed of a first material to provide a first Curie temperature or upper limit temperature to contents 1016 in the container 1002 and the second plurality of susceptor wires 1008 may be composed of a second material to provide a second Curie temperature or upper limit temperature to the contents 1016 of the container 1004, where the first Curie temperature is different than the second Curie temperature. Therefore, in operation the first susceptor wires 1004 may heat the contents 1016 to a temperature that is greater than or less than a temperature at which the second susceptor wires 1008 heat the contents 1016.

However, in other examples, each of the first and second plurality of susceptor wires 1004 and 1008 may be composed of the same or substantially similar material or Curie temperature to provide similar or equivalent upper limit or maximum temperatures to the contents 1016. Thus, when the susceptors wires 1004 and 1008 are composed of the same material or alloy and/or have approximately the same Curie temperatures, the example heating apparatus 1000 may provide uniform heating to the contents 1016 of the container 1002. For example, the susceptor wires 1004 and 1008 may provide uniform heating along the bottom surface 1010 and along the side walls 1006 and between the bottom surface 1010 and end or upper edge 1018 of the container 1002.

Figure 11:
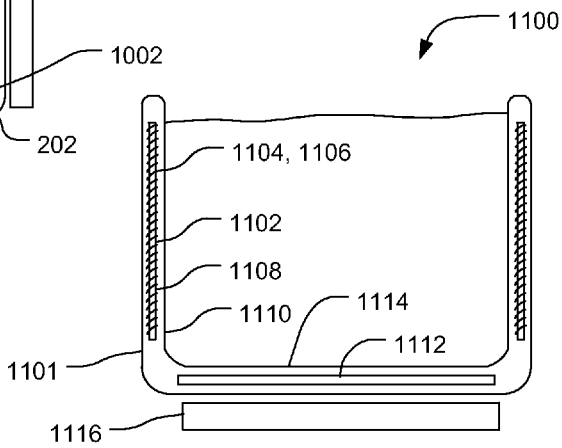

FIG. 11 illustrates yet another example heating apparatus 1100 disclosed herein. In the example of FIG. 11, the heating apparatus 1100 is a container 1101 having a first plurality of susceptor wires 1102 that employs an induction source 1104 to provide a magnetic field to the first plurality of susceptors wires 1102. In the illustrated example, the induction source 1104 is a plurality of conductors or wires 1106 (e.g., a relatively thin wire) wrapped or coiled about outer surfaces 1108 of the susceptor wires 1102. The conductors 1106 provide spaced apart loops along an axial direction of the susceptor wires 1102. The conductors 1106 receive electrical current from a power source (e.g., the power source 110 of FIG. 1) positioned outside of the container 1101 to generate a magnetic field.

In this example, although the conductors 1106 are in contact with the susceptor wires 1102, the susceptor wires 1102 are electrically isolated from the conductors 1106. For example, the conductors 1106 may include a sheath to electrically insulate the susceptor wires 1102 and the conductors 1106. In this example, the first plurality of susceptor wires 1102 and the conductors 1106 are positioned or embedded in a side wall 1110 of the container 1101.

The heating apparatus 1100 of the illustrated example may also employ a second plurality of susceptor wires 1112 positioned in a bottom surface 1114 of the container 1102, which are heated via a second induction source 1116 positioned outside of or adjacent (e.g., the bottom surface 1114) of the container 1102. However, in other examples, the second induction source 1116 may comprise wires similar to the wires 1106 that are wrapped around the second plurality of susceptor wires 1112 and positioned inside the bottom surface 1114 of the container 1101.

Figure 12:
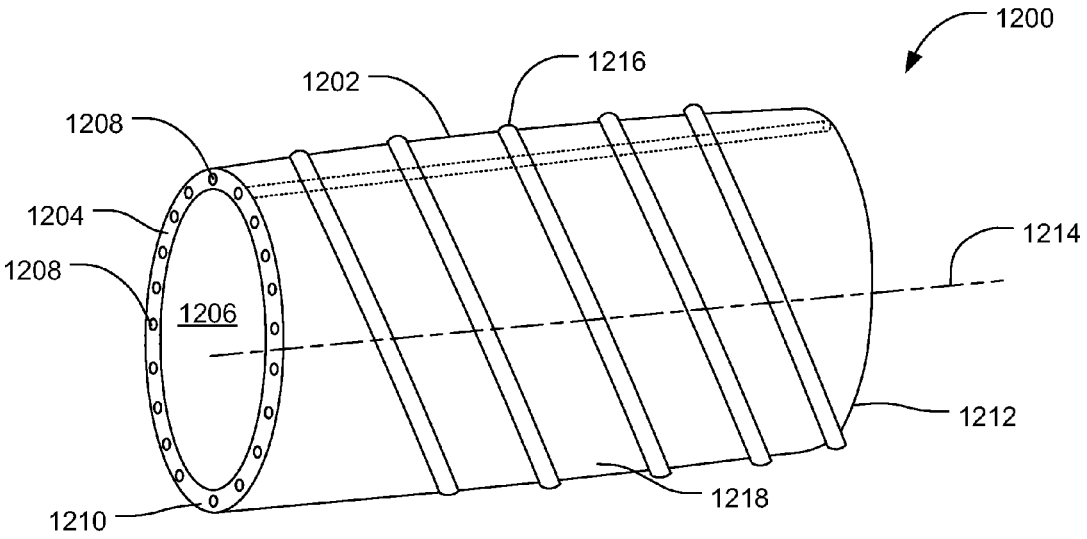

FIG. 12 illustrates yet another example heating apparatus 1200 disclosed herein. In the example of FIG. 12, the heating apparatus 1200 is a container or sleeve 1202 having a tubular profile or shape defining a wall 1204 (e.g., a cylindrical wall) and a passageway 1206. In some examples, the passageway 1206 may receive a fluid (e.g., a liquid or gas). Additionally or alternatively, the container 1202 may be a sleeve such that the passageway 1206 receives a body (e.g., a structure) that is to be heated. The container 1202 of the illustrated example has a plurality of susceptor wires 1208 formed, embedded and/or otherwise positioned in the wall 1204 of the container 1202 between a first end 1210 of the container 1202 and a second end 1212 of the container 1202. Each of the susceptor wires 1208 has an axis that extends along a longitudinal axis 1214 of the container 1202. In particular, the axes of the susceptor wires 1208 are substantially parallel to the longitudinal axis 1214 of the container 1202. In some examples, the susceptor wires 1208 may extend along a longitudinal length of the container 1202 and/or may be positioned only in designated areas along the longitudinal length of the container 1202 that require heating. Further, in some examples, the susceptor wires 1208 may extend along the longitudinal length of the container 1202 as a unitary body or structure. In some examples, a plurality of relatively shorter length susceptor wires (e.g., having their ends spaced apart or in abutting relationship) may be disposed in substantially parallel or aligned relationship relative to the longitudinal axis 1214 and along the longitudinal length of the container 1202. In some examples, the susceptor wires 1208 may be composed of the same material and/or may provide a substantially similar Currie temperature. Alternatively, one or more of the susceptor wires 1208 may be composed of different materials and/or provide different Curie temperatures.

The heating apparatus 1200 employs an induction source 1216 to provide a magnetic field to the susceptors wires 1208. In the illustrated example, the induction source 1216 is a conductor or wire (e.g., a relatively thin wire) wrapped or coiled about an outer surface 1218 of the container 1202. The conductor 1216 receives electrical current from a power source (e.g., the power source 110 of FIG. 1) positioned outside of the container 1202 to generate a magnetic field, which causes the susceptor wires 1208 to heat to a Curie temperature of the susceptor wires 1208. The heat generated by the susceptor wires 1208 heats a fluid flowing through the flow passageway 1206.

Alternatively, although not shown, each of the susceptor wires 1208 may have a wire coiled or wrapped around an outer surface of the susceptor wire. In some such examples, although a conductor is in contact with each of the susceptor wires 1208, the susceptor wires 1208 may be electrically isolated from the conductors. For example, the conductors may include a sheath to electrically insulate the susceptor wires 1208 and the conductors. In some such examples, the susceptor wires 1208 and the conductors are formed or positioned in the wall 1204 of the container 1202.

Figure 13:
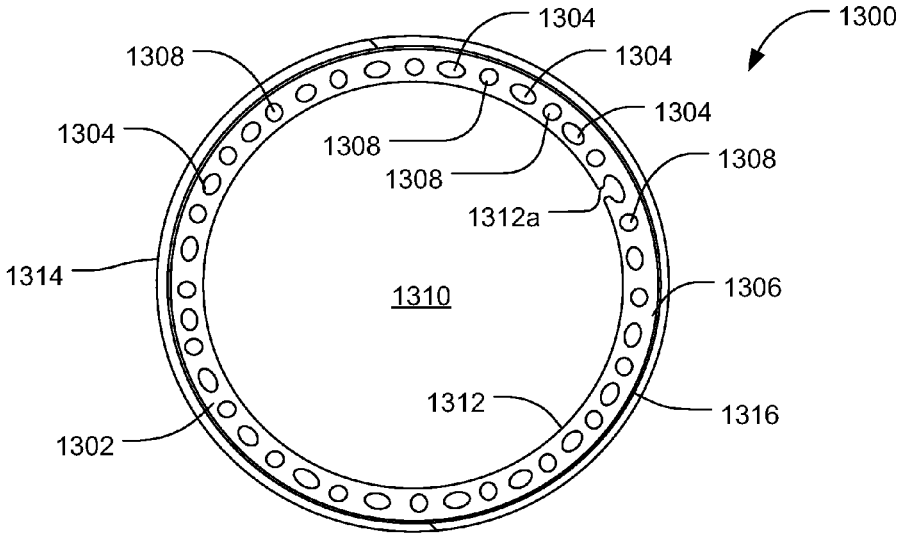

FIG. 13 illustrates yet another example heating apparatus 1300 disclosed herein. FIG. 13 illustrates a container 1302 that is similar to the container 1202 of FIG. 12, but includes a plurality of flow passages 1304 formed or positioned in a wall 1306 adjacent or between at least some of a plurality of susceptor wires 1308. The flow passages 1304 fluidly isolate and/or prevent a fluid flowing through the passageways 1304 from contacting the susceptor wires 1308. The container 1302 may also include a flow passageway 1310 that may be fluidly isolated from the flow passages 1304. Thus, the flow passages 1304 may receive a fluid that is different than a fluid received by the flow passageway 1310. Alternatively, the flow passageway 1310 may be fluidly coupled to the flow passages 1304 (e.g., via a channel 1312*a* in an inner surface 1312 of the wall 1306). Additionally or alternatively, in some examples, the flow passages 1304 and/or the flow passageway may receive a body or structure to be heated.

An induction source or wire 1314 is wrapped or coiled about an outer surface 1316 of the wall 1306 of the container 1302 to provide a magnetic field to the susceptors wires 1308. In operation, the induction source 1314 provides a magnetic field to the susceptor wires 1308 to cause the susceptor wires 1308 to heat to a Curie temperature of the susceptor wires 1308. The heat generated by the susceptor wires 1308 heats a fluid flowing through the flow passages 1304 and/or the flow passageway 1310.

Although certain example methods, apparatus and articles of manufacture have been described herein, the scope of coverage of this disclosure is not limited thereto. On the contrary, this disclosure covers all methods, apparatus and articles of manufacture fairly falling within the scope of the claims.

What is claimed is:

1. A heating apparatus comprising:

a container including a side wall and a bottom wall, the side wall defining a length between an upper edge and a lower edge;

a plurality of first susceptor wires embedded in the side wall of the container and radially spaced relative to a center axis of the container, each first susceptor wire includes an elongate body defining a first longitudinal axis, the first longitudinal axis of each first susceptor wire is substantially parallel relative to the center axis such that a first end of each first susceptor wire is adjacent the upper edge of the side wall and a second end of each first susceptor wire is adjacent a lower edge of the side wall, each first susceptor wire being composed of a first material having a relatively high magnetic permeability and a first Curie temperature characteristic, each first susceptor wire including a first outer surface extending along the first longitudinal axis, and a first core within the first outer surface and extending along the first longitudinal axis, a plurality of first conductor wires embedded in the side wall of the container, a respective one of the first conductor wires being wrapped about a corresponding respective one of the first susceptor wires, the respective one of the first conductor wires to receive electrical current from a power source to generate a corresponding respective first magnetic field, the corresponding respective first magnetic field to generate eddy currents circumferentially adjacent the first outer surface of the corresponding respective first susceptor wire when a temperature of the corresponding respective first susceptor wire is below the first Curie temperature characteristic and to generate eddy currents adjacent the first core of the corresponding respective first susceptor wire when the temperature of the corresponding respective first susceptor wire is equal to the first Curie temperature characteristic.

2. The apparatus of claim 1, wherein the power source is positioned outside of the container.

3. The apparatus of claim 1, wherein each first susceptor wire includes a skin depth that is about half of a diameter of the respective first susceptor wire.

4. The apparatus of claim 1, wherein each first susceptor wire has a constant diameter along a length extending between the first end and the second end.

5. The apparatus of claim 1, wherein each first susceptor wire is oriented in a linear pattern relative to the side wall of the container.

6. The apparatus of claim 1, wherein each first conductor wire includes a sheath to electrically isolate a respective first conductor wire from another respective first susceptor wire.

7. The apparatus of claim 1, further comprising:

a plurality of second susceptor wires embedded in the bottom wall of the container in a spaced apart configuration, each second susceptor wire composed of a second material having a relatively high magnetic permeability and a second Curie temperature characteristic, each second susceptor wire including a second longitudinal axis, a second outer surface extending along the second longitudinal axis, and a second core within the second outer surface and extending along the second longitudinal axis, the second longitudinal axis oriented substantially parallel relative to the bottom wall of the container; and an induction source to generate a second magnetic field, the second magnetic field to generate eddy currents circumferentially adjacent the second outer surface of each of the second susceptor wire when a temperature of the respective second susceptor wire is below the second Curie temperature characteristic and to generate eddy currents adjacent the second core of the respective second susceptor wire when the temperature of the respective second susceptor wire is equal to the second Curie temperature characteristic.

8. The apparatus of claim 7, wherein the induction source is positioned adjacent a bottom surface of the bottom wall.

9. The apparatus of claim 7, wherein the induction source comprises a plurality of second conductor wires embedded in the bottom wall of the container, a respective one of the second conductor wires being wrapped about a corresponding respective one of the second susceptor wires, the respective one of the second conductor wires to receive electrical current to generate the second magnetic field.

10. A heating apparatus comprising:

a container including a side wall and a bottom wall, the side wall being non-parallel relative to the bottom wall, the side wall having a center axis coaxially aligned with a center of the bottom wall;

a plurality of first susceptor wires embedded in the side wall, each first susceptor wire is a first elongate body defining a first longitudinal axis, each first susceptor wire being radially spaced relative to the center axis between an inner surface and an outer surface of the side wall such that the first longitudinal axis of each first susceptor wire is substantially parallel relative to the center axis, each first susceptor wire having a first outer surface and a first core relative to the first longitudinal axis, each first susceptor wire being composed of a first material or alloy having a relatively high magnetic permeability and a first Curie temperature characteristic, the first longitudinal axis of each first susceptor wire being oriented substantially parallel relative a first magnetic field generated by a first induction source to induce eddy currents circumferentially adjacent the first outer surface to provide a first heat output when a temperature of a respective first susceptor wire is less than the first Curie temperature characteristic and to induce eddy currents adjacent the first core and away from the first outer surface to reduce the first heat output when the temperature of the respective first susceptor wire is equal to the first Curie temperature characteristic, the first induction source including a plurality of first conductor wires embedded in the side wall of the container, a respective one of the first conductor wires being wrapped about a corresponding respective one of the first susceptor wires, the respective one of the first conductor wires to receive electrical current from a power source to generate the first magnetic field; and a plurality of second susceptor wires embedded in the bottom wall of the container, each second susceptor wire is a second elongate body defining a second longitudinal axis, each second susceptor wire being radially spaced relative to the center axis such that the longitudinal axis of each second susceptor wire is substantially perpendicular relative to the center axis, each second susceptor wire having a second outer surface and a second core relative to the second longitudinal axis, each second susceptor wire being composed of a second material or alloy having a relatively high magnetic permeability and a second Curie temperature characteristic, the second longitudinal axis of each second susceptor wire being oriented substantially parallel relative to a second magnetic field generated by a second induction source to induce eddy currents circumferentially adjacent the second outer surface to provide a second heat output when a temperature of a respective second susceptor wire is less than the second Curie temperature characteristic and to induce eddy currents adjacent the second core and away from the second outer surface to reduce the second heat output of the respective second susceptor wire when the temperature of the respective second susceptor wire is equal to the second Curie temperature characteristic.

11. The apparatus of claim 10, wherein the first material is different than the second material such that the first Curie temperature characteristic is different than the second Curie temperature characteristic.

12. The apparatus of claim 10, wherein the first material is substantially similar to the second material such that the first Curie temperature characteristic is substantially similar to the second Curie temperature characteristic.

13. The apparatus of claim 10, wherein the second induction source is positioned adjacent a bottom surface of the bottom wall.

14. The apparatus of claim 10, wherein the second induction source comprises a plurality of second conductor wires embedded in the bottom wall of the container, a respective one of the second conductor wires being wrapped about a corresponding respective one of the second susceptor wires.

15. The apparatus of claim 14, wherein each second conductor wire is to receive electrical current to generate the second magnetic field.

16. The apparatus of claim 10, wherein a respective one of the first conductor wires includes a sheath to electrically isolate the respective one of the first conductor wires from the first susceptor wires.

17. A heating apparatus comprising:

a container including a side wall, the side wall defining a center axis; and a plurality of first susceptor wires embedded in the side wall of the container and radially spaced relative to the center axis of the container, each first susceptor wire including a body having a first longitudinal axis between a first end and a second end opposite the first end, the first longitudinal axis of each first susceptor wire being substantially parallel relative to the center axis of the container such that the first end of each first susceptor wire is adjacent an upper edge of the side wall and the second end of each first susceptor wire is adjacent a lower edge of the side wall.

18. The apparatus of claim 17, wherein each first susceptor wire is composed of a first material having a relatively high magnetic permeability and a first Curie temperature characteristic, and each first susceptor wire includes an outer surface extending along the first longitudinal axis and a core within the outer surface.

19. The apparatus of claim 18, further including a plurality of conductor wires embedded in the side wall, a respective one of the conductor wires being wrapped about a corresponding respective one of the first susceptor wires, the respective one of the conductor wires to receive electrical current from a power source to generate a corresponding respective first magnetic field, the corresponding respective first magnetic field to generate eddy currents circumferentially adjacent the outer surface of the corresponding first susceptor wire when a temperature of the corresponding respective first susceptor wire is below the first Curie temperature characteristic and to generate eddy currents adjacent the core of the corresponding respective first susceptor wire when the temperature of the corresponding respective first susceptor wire is equal to the first Curie temperature characteristic.

20. The apparatus of claim 17, wherein the container further includes a bottom wall adjacent the lower edge of the side wall, and further including a plurality of second susceptor wires embedded in the bottom wall of the container, each second susceptor wire including an elongate body defining a length between a first end and a second end opposite the first end, each second susceptor wire defining a second longitudinal axis between the first end and the second end, each second susceptor wire being radially spaced relative to the center axis such that the second longitudinal axis of each second susceptor wire is substantially perpendicular relative to the center axis of the container and the first end is adjacent the center axis and the second end is adjacent a peripheral edge of the bottom wall, each second susceptor wire being composed of a second material having a relatively high magnetic permeability and a second Curie temperature characteristic.

21. The apparatus of claim 20, wherein each second susceptor wire includes an outer surface extending along the second longitudinal axis, and a core within the outer surface and extending along the longitudinal axis.

22. The apparatus of claim 20, further including an induction source to be positioned adjacent the bottom wall to generate a second magnetic field.

23. The apparatus of claim 17, wherein the container further includes a bottom wall adjacent the lower edge of the side wall, and further including a plurality of second susceptor wires embedded in the bottom wall of the container and radially spaced relative to the center axis, each second susceptor wire including:

an elongate body defining a length between a first end and a second end opposite the first end, the first end being adjacent the center axis and the second end being adjacent a peripheral edge of the bottom wall;

a second longitudinal axis between the first end and the second end, wherein the second longitudinal axis of each second susceptor wires is substantially perpendicular relative to the center axis of the container; and a second material having a relatively high magnetic permeability and a second Curie temperature characteristic.

24. The apparatus of claim 23, wherein each second susceptor wire includes an outer surface extending along the second longitudinal axis, and a core within the outer surface and extending along the longitudinal axis.

25. The apparatus of claim 23, further including an induction source to be positioned adjacent the bottom wall to generate a second magnetic field.

* * * * *